United States Patent [19]

Ishida et al.

[11] Patent Number: 4,545,220

[45] Date of Patent: Oct. 8, 1985

[54] WASHING MACHINE

[75] Inventors: Katsuyuki Ishida; Naotaka Ikeda, both of Aichi, Japan

[73] Assignee: Tokyo Shibaura Denki Kabushiki Kaisha, Kawasaki, Japan

[21] Appl. No.: 550,030

[22] Filed: Nov. 8, 1983

[30] Foreign Application Priority Data

Nov. 18, 1982 [JP] Japan ..... 57-202421

[51] Int. Cl.[4] ..... D06F 17/08; D06F 17/10

[52] U.S. Cl. ..... 68/133; 68/23.7; 68/134

[58] Field of Search ..... 68/133, 23.7, 134, 136, 68/138, 53, 54, 131, 89; 366/276, 278

[56] References Cited

U.S. PATENT DOCUMENTS

| | | | |
|---|---|---|---|
| 1,859,033 | 5/1932 | Gibson | 68/133 |
| 1,861,640 | 6/1932 | McCabe | 366/278 X |
| 2,255,505 | 9/1941 | Dunham | 68/133 X |
| 2,674,868 | 5/1954 | Williams | 68/23.7 |
| 3,307,383 | 3/1967 | Cobb et al. | 68/133 UX |

FOREIGN PATENT DOCUMENTS

| | | | |
|---|---|---|---|
| 134925 | 10/1949 | Australia | 68/133 |
| 531315 | 9/1954 | Belgium | 68/133 |
| 514001 | 2/1955 | Italy | 68/131 |
| 51-160983 | 7/1976 | Japan . | |
| 51-90668 | 12/1976 | Japan . | |
| 55-37101 | 1/1980 | Japan . | |
| 761911 | 11/1956 | United Kingdom | 68/133 |

*Primary Examiner*—Philip R. Coe
*Assistant Examiner*—Frankie L. Stinson
*Attorney, Agent, or Firm*—Cushman, Darby & Cushman

[57] ABSTRACT

A washing machine having an improved pulsator which includes a skirt, vanes projecting from the skirt, and a rod-like projection located at a position offset from the center of rotation of the skirt and extended to a position higher than the vanes. The pulsator rotates in the forward and reverse directions to responsively effect satellite motion of the rod-like projection about the central axis of rotation so that highly turbulant localized water flow is established in conjunction with a vortex flow arrangement to enhance the washing capabilities of the machine.

2 Claims, 4 Drawing Figures

WASHING MACHINE

BACKGROUND OF THE INVENTION

Conventional washing machines generally accomplish washing action by establishing a vortex flow within a washing tub to repeatedly draw articles being washed in the tub of the machine from the upper region thereof to the lower region along the agitator and then return them once again to the upper region along the walls of the tub. In such a manner, the articles being washed will contact not only one another but also the agitator and walls of the tub to produce the desired rubbing action necessary to completely clean them. Thus, the articles being washed are subjected to agitation and movement through the tub so as to accomplish the desired washing function.

However, such conventional washing machines oftentimes fail to completely achieve their intended purpose of establishing a sufficient vortex flow within the tub so as to induce circulated movement of the articles therein. Furthermore, as the weight of the washed articles increases, hydraulic forces induced by conventional agitators may be insufficient to produce the intended circulation leading to undesirable stratification of the articles in the tub and the stagnation of the washing liquid therein. Accordingly, many conventional washing machines do not always wash articles to the degree that is expected by consumers.

There have, of course, been attempts in the art for enhancing the agitation capabilities of washing machines so as to provide positive flow of the articles being washed through the wash liquid. One such proposal is shown in U.S. Pat. No. 4,207,760 to Bochan. The rotatable agitator of the Bochan patent utilizes vane blade pairs disposed along the base and inclined with respect to one another so as to form a V-shaped trough. Radial vanes are provided, each associated with a respective V-shaped trough, so as to "pull" fabric articles in the upper region of the tub towards the center of the agitator.

The V-shaped troughs of Bochan effect mechanical engagement of the fabric articles to slide them radially outwardly at the base of the agitator and this effect is enhanced by the vanes pulling the clothes in at the upper region of the tub and guiding them down into the V-shaped trough. However, such an effect does not depend upon the fluid conditions in the tub owing to the mechanical engagement of the V-shaped troughs and vanes with the fabric articles. Accordingly, whereas the agitator of Bochan may enhance the washing capabilities of the machine, an undesirable degree of abrasion may be experienced by the fabric articles owing to the mechanical engagment of the V-shaped troughs and vanes therewith.

SUMMARY OF THE PRESENT INVENTION

In accordance with the present invention, a washing machine can achieve highly satisfactory washing of fabric articles when equipped with an improved pulsator. The improved pulsator of the present invention achieves such results by establishing localized, highly agitated turbulent flow near the central pulsator column due to an upstanding rod-like member which is offset with respect to the central axis of rotation of the pulsator. Moreover, in accordance with the present invention, the pulsator dramatically improves and enhances vortex flow-inducing characteristics of conventional radially extending vanes due to the localized areas of highly agitated turbulent flow.

The rod-like member extends above the uppermost end of the vanes so as to establish the highly agitated localized flow briefly described above. Thus, in accordance with the present invention flow patterns of a sufficient force are induced to clean the fabric articles due to hydraulic action of the washing liquid. Additionally, since the present invention does not solely depend upon mechanical engagement of the pulsator with the fabric articles to achieve satisfactory washing, the rod-like member of the present invention can be provided with a smoothly rounded external surface. Thus, although the rod-like member will contact and rub against the fabric articles during the washing cycles to further enhance the washing thereof, such rubbing action will not be unduly abrasive due to the smoothly rounded external surfaces. Accordingly, mechanical enhancement of the washing function can be utilized without fear of damaging the fabric articles.

Furthermore, the rod-like member of the present invention, due to its offset relationship with respect to the axis of rotation of the pulsator, provides compressive washing of the fabric articles as the rod-like member moves in a satellite motion about the rotational axis.

These and other advantages of the present invention will become more clear to the reader after careful consideration is given to the detailed description of the preferred exemplarly embodiment thereof which follows.

BRIEF DESCRIPTION OF THE ACCOMPANYING DRAWINGS

Reference will be hereinafter made to the accompanying drawings, forming a part hereof, in which like reference numerals throughout the various Figures denote like structural elements, and wherein.

DETAILED DESCRIPTION OF THE PREFERRED EXEMPLARY EMBODIMENT

A particularly preferred exemplary embodiment of the present invention will now be explained and the reader's attention is specifically directed to the accompanying drawings for the discussion which follows.

Figure 1:
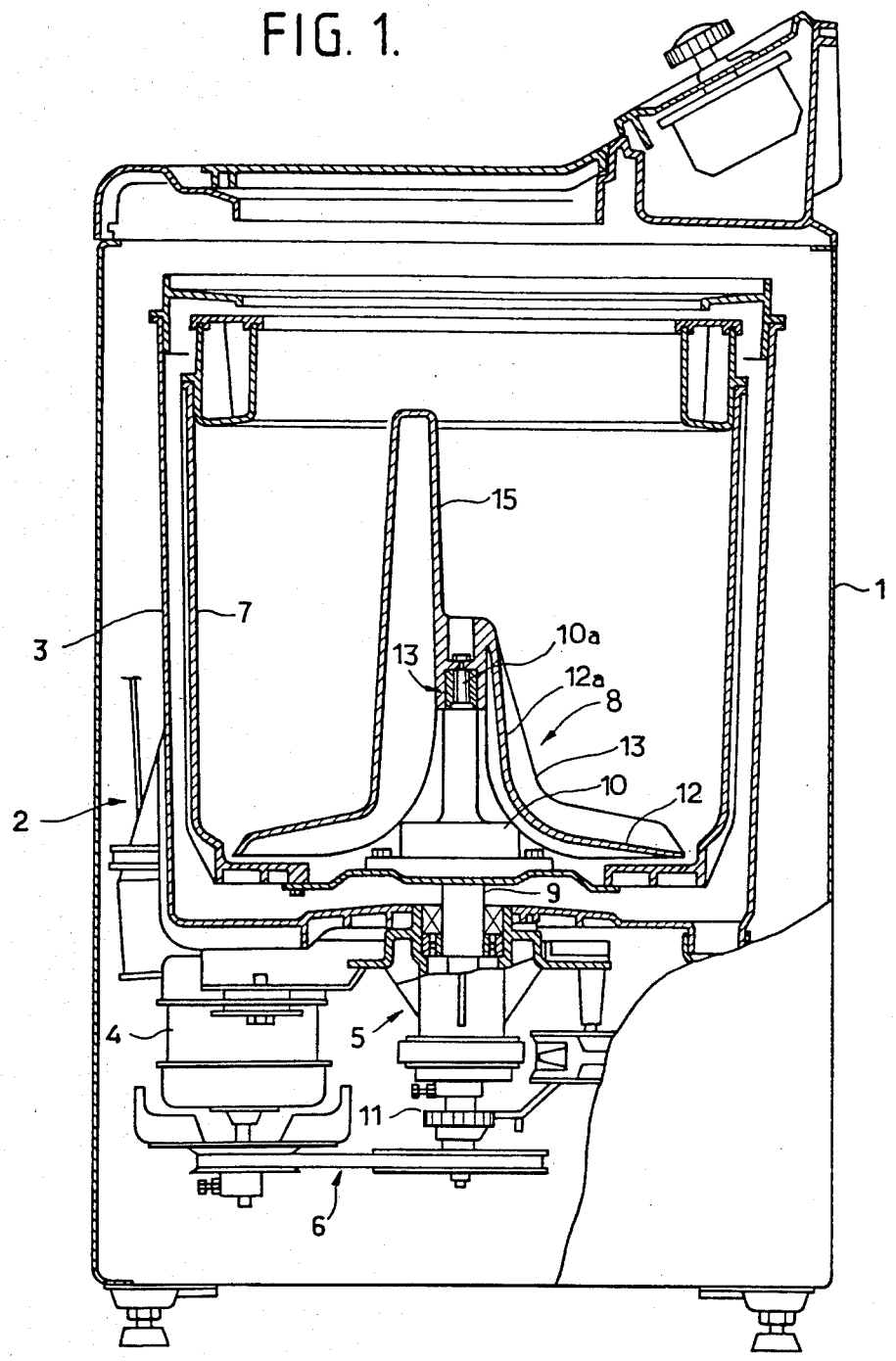
FIG. 1 is a side view, partially in section, of a washing machine according to the present invention.

As can be seen in FIG. 1, casing 1 includes a water-receiving tub 3 suspended by elastic suspension member 2, so as to absorb erratic movement of the tub 3. Pulsator 8 is centrally mounted in the interior of tub 3 for rotary movement therein, the purpose and function of which will be described in more detail below. Water receiving tub 3 is itself fixedly mounted with respect to rotary tub 7 which, in the embodiment of the washing machine shown, serves the dual purpose of a washing and drying tub. The reader should, of course, appreciate that the present invention can also be suitably utilized when tub 7 is solely a washing tub.

The rotary tub 7 is fixedly connected to rotary shaft 9 of a mechanism section 5 which transmits rotary movement in a predetermined manner thereto while pulsator 8 is connected to mechanism section 5 by a separate pulsator shaft (not shown) operatively interconnected with a reduction gear system 10 provided in the interior lower region of rotary tub 7.

The mechanism section 5 includes a clutch mechanism 11 for selectively transmitting the rotary motion provided by drive motor 4 to the pulsator shaft and to the rotary shaft 9 in such a manner that during washing cycles, the pulsator 8 is independently rotated while during drying cycles both the rotary tub 7 and the pulsator 8 are rotated as a unit. Moreover, pulsator 8 is permitted to rotate in forward and reverse directions in successively repeated cycles. For example, pulsator 8 can rotate through three revolutions in the forward direction followed by rotation through three revolutions in the reverse direction. This cycle of operation is successively repeated so as to induce agitation of the wash liquid in the tub 7.

Figure 2:
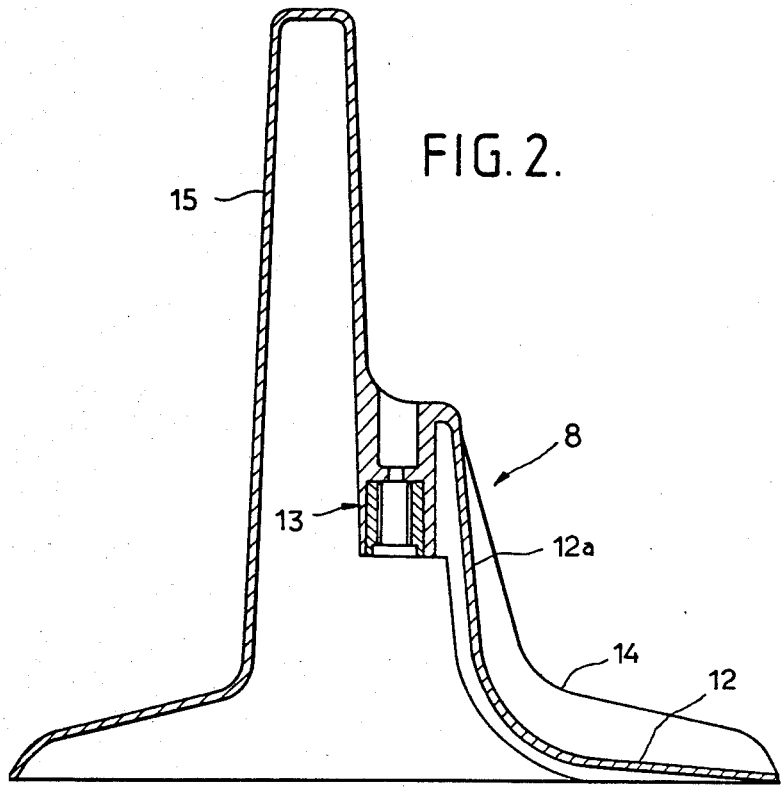
FIG. 2 is a cross-sectional elevational view of the pulsator of the present invention.
Figure 3:
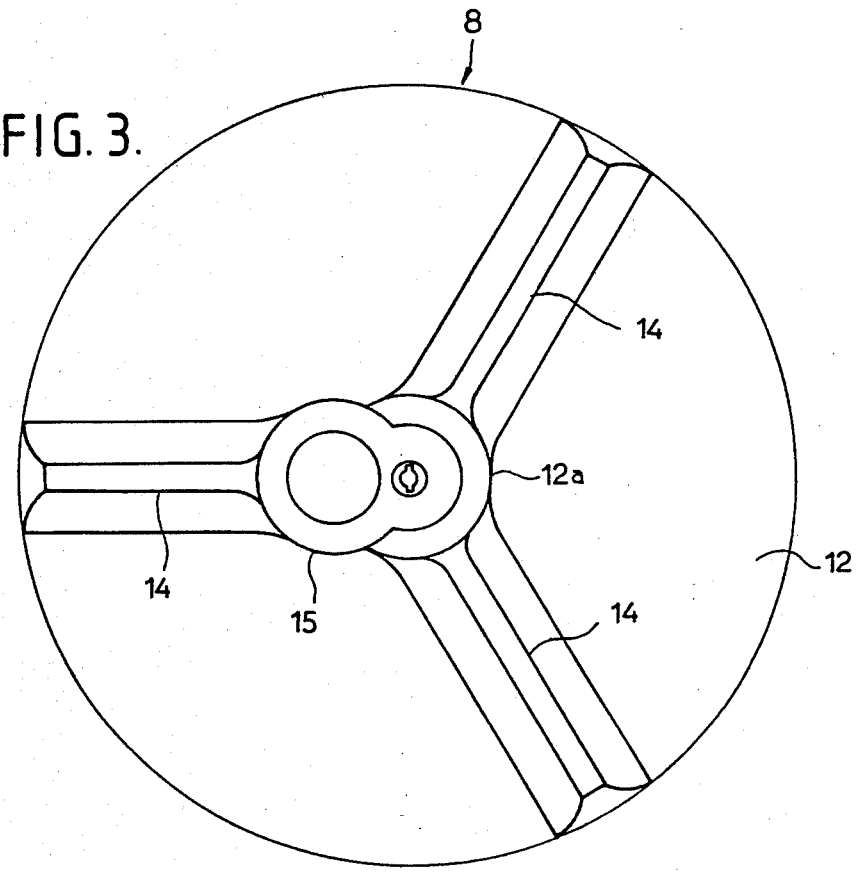
FIG. 3 is a plan view of the pulsator depicted in FIG. 2.

The detailed construction of the pulsator 8 of the present invention will now be described and the reader's attention is specifically directed to accompanying FIGS. 2 and 3.

Skirt 12 virtually extends over the entire interior bottom region of rotary tub 7. Skirt 12 includes an integral central portion 12*a* that is upwardly projected therefrom to define an interior space for housing the reduction gear mechanism 10 (see FIG. 1). Shaft coupling 13 is provided in the upper region of central portion 12*a* for coupling pulsator 8 to an output shaft 10*a* operatively associated with reduction gear system 10 (see FIG. 1). Vanes 14 are radially disposed at equally separated locations on skirt 12 and extend from central portion 11*a* to the periphery of skirt 12. The height of projection 12*a* is preferably 170 mm.

A rod-shaped projection 15 is located at a position somewhat offset from the center axis defined by shaft coupling 13 which provides the center of rotation of the skirt 12, for example projection 15 is located at a position corresponding to one of the three vanes 14. Projection 15 is upwardly projected higher than the uppermost extent of vanes 14 and can project about 340 mm, for example. Preferably, the top projection 15 is such that it is disposed near the opening to tub 7.

The operation of the above construction will now be explained. Considering first of all the wash cycle, when the pulsator 8 is rotated, the washing water in the rotary tub 7, taken as a whole, is formed into a vortex by the vanes 14 in a manner which is known. However, this known vortex flow arrangement is significantly enhanced by the rod-shaped projection 15 since it projects higher than the vanes 14, resulting in localized turbulent flow within the vortex.

Fabric articles A (see FIG. 4) that are held in the rotary tub 7 with the washing liquid are therefore induced to assume complex motions by the flow established by the localized turbulent interruption of the vortex flow by projection 15. Thus, fabric articles A are moved about and hydraulically manipulated in a complex manner due to the complex flow established by the pulsator 8 to subject them to hydraulic wringing and scrubbing actions and to thus increase the cleansing effect.

Figure 4:
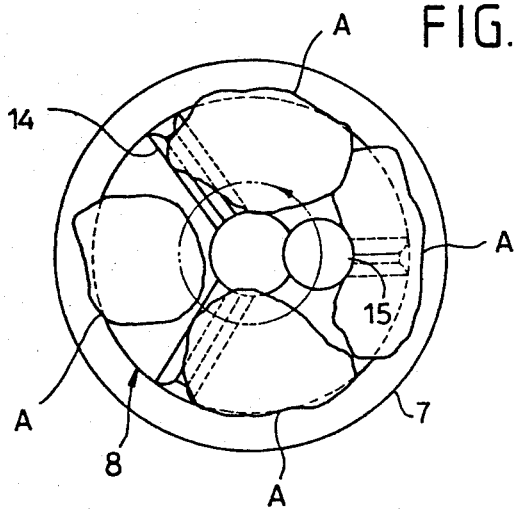
FIG. 4 is a diagrammatic plan view showing the rotary tub portion and action of the pulsator therein.

In particular, due to the rotation of the pulsator 8, the rod-shaped projection 15 travels in a circular satellite motion around the axis of rotation for rotary tub 7 as shown by the arrow in FIG. 4. During such satellite motion, projection 15 encounters a portion of the fabric articles and, due to the hydraulic action of the vortex flow tending to draw the articles in towards the central portion of the rotary tub, the articles will be pressed against the external surface of projection 15 to provide external compressive forces to the articles. Such compressive forces induce wash liquid to flow through the fabric articles so as to aid in the removal of soil, dirt or the like which may be trapped in the interstices thereof.

Moreover, as the projection 15 moves along its satellite path it rubs against portions of the fabric articles to further enhance the cleansing effect thereof. External hydraulic forces are also applied against the fabric articles due to the localized areas of highly turbulant flow that are induced during satellite movement of projection 15 through the wash liquid. Such external hydraulic forces serve to randomly manipulate the fabric articles and thus promote the cleansing effect.

Moreover, in the period of transistion when the pulsator 8 changes its rotation between the forward and reverse directions, the fabric articles A are temporarily substantially stationary whereas the pulsator 8 is already moving in the reverse direction due to the fact that there is a dwell interval between direction reversal of the pulsator 8 and the responsive direction reversal of the vortex flow. Thus, the rod-shaped projection 15 of the pulsator 8 functions to also apply a more positive and powerful drawing and squeezing action to the fabric articles A while in this stationary state than it does while the articles A are moving. This action therefore effectively promotes the compressive and rubbing forces described earlier the combination of which achieves a high cleansing effect.

Also, in this invention, since the reversal cycle of the pulsator 8 is preselected at about three rotations, the forces tending to compress, randomly manipulate and rub the articles, promotes efficient washing operations which can be adequately and uniformly performed on all of the fabric articles A. However, it should be noted that a reversal of at least one revolution can be just as adequately effective.

As the reader will now undoubtedly appreciate from the above description, by establishing forward and reverse rotation during the washing operation, more complex water currents than the conventional vortex current can be produced and thus a better cleansing effect by hydraulic action can be achieved.

In particular, compressive-type washing, random manipulative-type washing and rubbing-type washing can be performed on the fabric articles by means of the external forces exerted by the rod-shaped projection 15. Thus, the washing effect can be very greatly improved.

The illustrated embodiment should not be considered to be restrictive, but rather, those in this art may recognize that various changes may be made without departing from the scope of the invention, as defined in the appended claims, which claims shall be accorded the broadest interpretation thereof to encompass all equivalent structures and/or assemblies.

What is claimed is:

1. A washing machine comprising:

tub means defining an interior area for holding liquid therein;

a pulsator rotatably mounted relative to said tub means and disposed in said interior area thereof, said pulsator including a skirt area having a raised central portion extending to a predetermined upper limit and defining a central axis of rotation, plural vane means radially extending from said upper limit to the periphery of said skirt to establish vortex flow within said liquid, and means fixed to said skirt for enhancing the agitation of said liquid in said tub, said agitation enhancing means defining a second axis parallel to and separated from said central axis and being upwardly extended beyond said uppermost limit of said central portion; and drive means connected to said pulsator for rotating said pulsator in predetermined forward and reverse cycles about said central axis, wherein said agitation enhancing means rotates in a satellite fashion about said central axis upon rotation of said pulsator by said drive means to establish localized areas of highly turbulent flow within said vortex flow so that fabric articles will be randomly turbulently manipulated when enountering said turbulent flow and wherein said agitation enhancing means creates a force generally opposite said direction of vortex flow in the upper region of said tub means when said agitator enhancing comes into contact with said fabric articles to compress said fabric articles to facilitate the cleansing thereof.

2. A washing machine as in claim 1 wherein said agitation enhancing means includes means defining smoothly rounded external surfaces to prevent excessive mechanical abrasion of said fabric articles when said agitation enhancing means comes into contact therewith.

* * * * *